US007024753B2

(12) United States Patent
Leisten et al.

(10) Patent No.: US 7,024,753 B2
(45) Date of Patent: Apr. 11, 2006

(54) METHOD OF MANUFACTURING AN INDUCTOR

(75) Inventors: Joe Leisten, Renfrewshire (GB); Brian Lees, Renfrewshire (GB); Stuart Dodds, Renfrewshire (GB)

(73) Assignee: Minebea C. Ltd., (JP)

( * ) Notice: Subject to any disclaimer, the term of this patent is extended or adjusted under 35 U.S.C. 154(b) by 361 days.

(21) Appl. No.: 10/417,508

(22) Filed: Apr. 17, 2003

(65) Prior Publication Data

US 2003/0227363 A1 Dec. 11, 2003

Related U.S. Application Data

(63) Continuation of application No. 10/204,482, filed as application No. PCT/GB01/03855 on Aug. 29, 2001.

(30) Foreign Application Priority Data

Sep. 1, 2000 (GB) ..... 0021499

(51) Int. Cl.

| | |
|---|---|
| ***H01F 7/06*** | (2006.01) |
| ***H01H 75/00*** | (2006.01) |
| ***H01H 77/00*** | (2006.01) |
| ***H01H 83/00*** | (2006.01) |

(52) U.S. Cl. ..... 29/602.1; 29/593; 29/602; 29/605; 335/13; 703/13

(58) Field of Classification Search ..... 29/602.1, 29/605, 602, 593; 335/13, 40, 42, 90; 360/115, 360/120, 121; 703/13
See application file for complete search history.

(56) References Cited

U.S. PATENT DOCUMENTS

| | | | | |
|---|---|---|---|---|
| 5,130,876 | A * | 7/1992 | Gooch | 360/115 |
| 5,539,296 | A * | 7/1996 | Ito | 320/108 |
| 5,719,546 | A * | 2/1998 | Ito et al. | 336/180 |
| 5,942,893 | A * | 8/1999 | Terpay | 324/207.18 |

* cited by examiner

*Primary Examiner*—A. Dexter Tugbang
*Assistant Examiner*—Tai Nguyen
(74) *Attorney, Agent, or Firm*—Ipsolon LLP

(57) ABSTRACT

An inductor comprising a core, wherein the inductor is produced by the steps of: defining physical parameters of the core of the inductor, the physical parameters including dimensions of the air gap; defining a plurality of branches of the core; approximating the relative permeability of the core material by interpolating between first and second known values of magnetic flux density that exist in the core material when the core material is exposed to first and second values of magnetic field strength, respectively; calculating boundary currents that must flow through the inductor for each of the first and second known values of magnetic flux density to exist in each branch of the core; establishing the inductance of the inductor at each of the calculated boundary currents; and constructing the inductor.

11 Claims, 6 Drawing Sheets

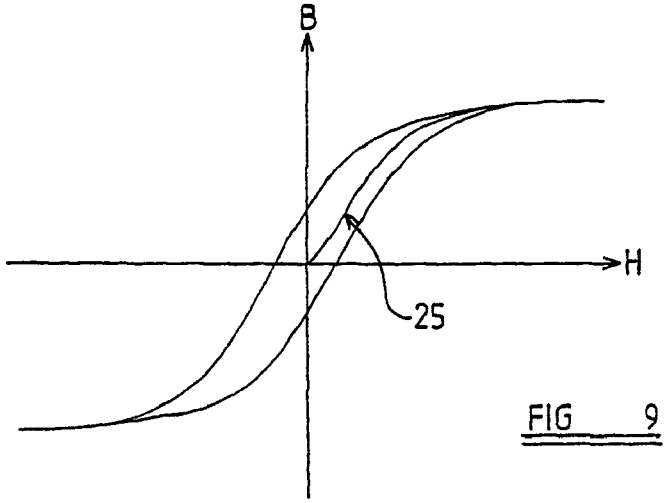
FIG 9
FIG 10
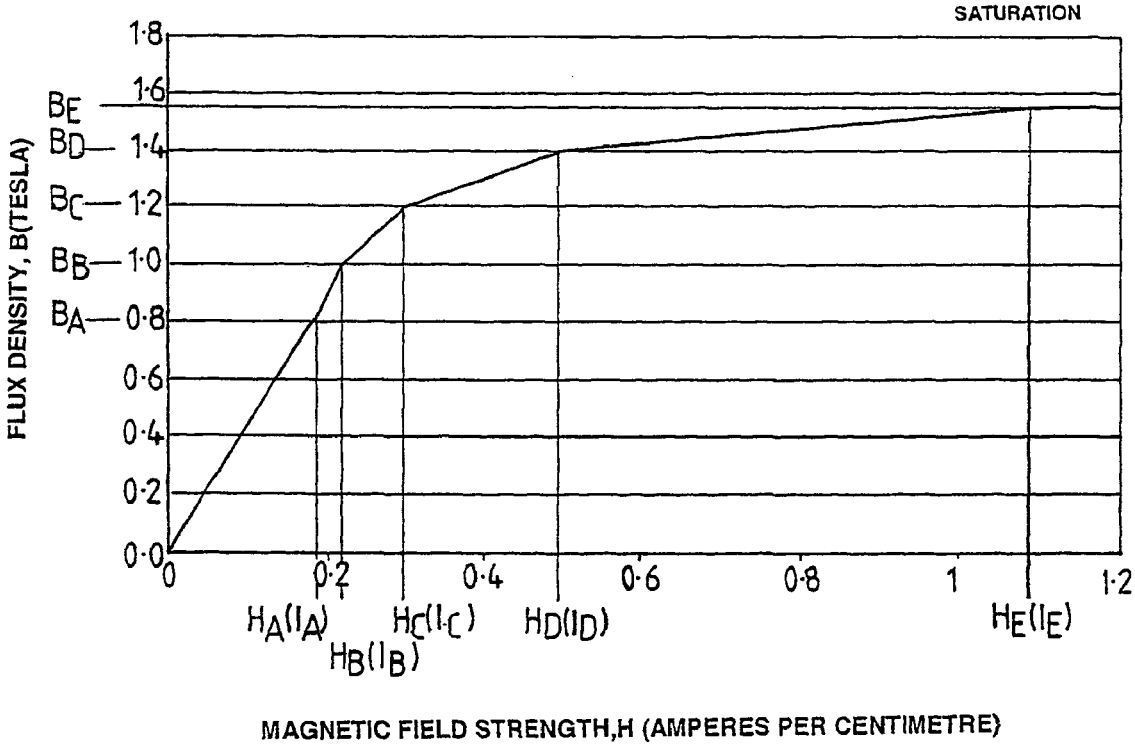

METHOD OF MANUFACTURING AN INDUCTOR

FIELD OF THE INVENTION

THIS INVENTION relates to a method of manufacturing an inductor, and in particular to a method of optimally designing a passive power factor correction inductor comprising a core having a stepped air gap.

BACKGROUND

Many machines require a power supply to convert incoming AC voltage (for instance from the mains) to low voltage DC as required by circuitry within the machines. One method of achieving this is the use of linear power supplies. These are relatively uncomplicated, and employ a mains transformer, rectifiers, smoothing capacitors, power semiconductor pass elements and small active/passive feedback components to stabilise the low voltage DC. The primary drawback of linear power supplies is that they are heavy, bulky and only around 40% efficient, which gives rise to a lack of competitiveness.

An alternative is to use a switched mode power supply (SMPS). A SMPS connects the incoming AC power supply to the load (ie the machine to be powered) by a forward-biased diode bridge and comprises a bulk capacitor connected in parallel with the load. A schematic representation of the circuitry of a rectifier stage of a basic SMPS is shown in FIG. 1 of the accompanying drawings.

SMPS's are, in general, more efficient than linear power supplies, and 70%–80% efficiency at full rated load is readily achievable. The size of the energy storage components can also be much less, due to the high switching frequency compared with mains input. These advantages make SMPS's a favourable option. SMPS's presently comprise around 60% of the power supplies manufactured worldwide.

One drawback of both SMPS's and linear power supplies is that these devices draw an inherently non-sinusoidal current from AC power sources. This is due (in the case of SMPS's) to the fact that, since the bulk capacitor and the power source are connected to one another by a forward-biased diode bridge, current will only flow from the power source to the bulk capacitor and the load when the power supply voltage exceeds the voltage across the capacitor. No current will flow from the power source at other times. Clearly, this leads to short periods of current flow near the peak of each AC cycle of the power source. The effect of this is to introduce undesirable harmonics into the power source.

The introduction of harmonics has a number of undesirable impacts on the electrical distribution system including increased root mean square (ie heating) current in the system wiring for a given load. This results in a reduced power factor of the electrical current drawn from the AC power source and may cause tripping of protection equipment at lower power delivery levels than would otherwise be the case.

At the time of writing, new regulations are to be introduced that set a limit on the harmonics associated with the current distortion described above. It will soon be mandatory for the harmonic levels introduced by a power supply to be within the limits set by the regulatory specifications. One approach to complying with these regulations, when using an SMPS, is the use of passive power factor correction, using an inductor, with little or no additional circuitry, to draw a smoother current from the power source.

Passive power factor correction requires relatively few components, and in its simplest form comprises an inductor located at any point in the rectifier circuitry, provided that it is placed before the capacitor. The inductor is often located between the forward-biased diode bridge and the bulk capacitor, for reasons that will be explained below. The competitive nature of, in particular, the market for personal computer power supplies (for which SMPS's are well-suited) generates great pressures to minimise costs. For this reason, the simplicity of design offered by passive power factor correction is an attractive feature. However, the size and weight of the inductor introduced into the power supply is a key consideration.

In order to comply with present harmonic current legislation, any device drawing an input power greater than 50W must limit the current harmonics introduced into the power source to within specified levels, which are dependent on the power drawn. It is, for a device that may draw an input power above 50W, necessary to provide an inductor that will maintain the introduced current harmonics to below the specified levels when the device draws an input power between 50W and full input power. If there is a significant power range over which compliance with harmonic regulations is to be achieved, an inductor whose inductance varies with the current flowing therethrough is essential if the size and weight of the inductor are to be kept to a minimum.

In modern inductor design, in order to maximise the energy associated with the flux in the core of an inductor, and therefore to reduce the size of the inductor, it is normal to introduce a small air gap into the magnetic circuit comprising the inductor. This can, in certain types of core, be achieved by the introduction into the magnetic circuit of a thin piece of insulating material of the thickness required, to maintain the correct dimensions of the "air" gap. As saturation of the core is reached, the relative permeability of the core will tend towards unity, equaling the permeability of the air gap. The presence of such an air gap leads to an inductor having an inductance that varies with the current passing therethrough. The provision of a core having a profiled air gap (i.e. one having a varying width) allows control to be exercised over the variation of the inductance with current, and this phenomenon may be exploited to produce an efficient inductor for passive power factor correction, as described above.

However, the behaviour of such an inductor is extremely difficult to model, and a drawback of this technique is that it is very difficult to predict the inductance-current relationship of a stepped-gap inductor without actually building one.

SUMMARY OF THE INVENTION

It is an object of the present invention to seek to provide an improved method of manufacturing a passive power factor correction inductor.

Accordingly, one aspect of the present invention provides a method of manufacturing an inductor having a core comprising an air gap having a varying width, the method comprising: designing the inductor, including the steps of: defining physical parameters of the core of the inductor, the physical parameters including dimensions of the air gap; defining a plurality of branches of the core; approximating the relative permeability of the core material by interpolating between first and second known values of magnetic flux density that exist in the core material when the core material is exposed to first and second values of magnetic field strength, respectively; calculating boundary currents that must flow through the inductor for each of the first and second known values of magnetic flux density to exist in each branch of the core; and establishing the inductance of the inductor at each of the calculated boundary currents, and constructing the inductor.

Advantageously, the method further comprises the step of interpolating between the inductances of the inductor at each of the calculated boundary currents to approximate a continuous inductance/current relationship for the inductor.

Preferably, the method further comprises the step of calculating the magnetic path length of each branch of the core when each of the first and second known values of magnetic flux density exists in that branch of the core.

Conveniently, the step of defining the dimensions of an air gap comprises the step of defining the dimensions of a plurality of steps of the air gap, the steps having different widths.

Advantageously, the step of defining the dimensions of a plurality of steps of the air gap comprises the step of defining the dimensions of three steps of the air gap.

Preferably, the step of defining a plurality of branches of the core comprises the step of defining a plurality of branches of the core each of which comprises a step of the air gap.

Conveniently, the step of defining dimensions of the air gap comprises the step of defining a continuously varying width of the air gap.

Advantageously, the step of calculating the magnetic path length of each branch of the core when each known value of magnetic flux density exists in that branch of the core comprises the step of solving the equation $$D=D_G+D_B+D_M$$

where D is the magnetic path length of the branch of the core in question, $D_G$ is the magnetic path length of the air gap in that branch of the core, $D_B$ is the magnetic path length of any butt gaps that exist in the core and $D_M$ is the magnetic path length in the core material in that branch of the core.

Preferably, the step of calculating boundary currents that must flow through the inductor for each of the known values of magnetic flux density to exist in each branch of the core comprises the step of solving the equation $$B_n = \frac{\mu_n N I_n}{D}$$

where $B_n$ is the nth known value of magnetic flux density, $\mu_n$ is the relative permeability of the core material when the nth value of magnetic flux density exists in the core material, N is the number of turns of a winding of the inductor and $I_n$ is the boundary current that must flow through the inductor for the nth value of magnetic flux density to exist in the branch of the core in question.

Conveniently, the method further comprises the step of assigning values of relative permeability to each branch of the core of the inductor for each of the calculated boundary currents.

Advantageously, the step of establishing the inductance of the inductor at each of the calculated boundary currents comprises the step of solving the equation $$L = \mu_0 N^2 A_m \sum_i^n \left( \frac{\alpha_i}{D_G + D_B + \frac{D_M}{\mu_i}} \right)$$

where L is the inductance of the inductor at a selected boundary current, $A_m$ is the cross-sectional area of the magnetic path perpendicular to the direction of flux, y is the total number of branched of the core, $\alpha_x$ is the proportion of $A_m$ occupied by the ith branch of the core, $\mu_x$ is the relative permeability assigned to the ith branch of the core when the boundary current in question flows through the inductor and n is the total number of branches of the core.

In order that the present invention may be more readily understood, embodiments thereof will now be described, by way of example, with reference to the accompanying drawings, in which:

BRIEF DESCRIPTION OF THE DRAWINGS

FIG. 9 is a graph showing the relationship between magnetic flux density and magnetic field strength for a typical inductor core material;

FIG. 10 is a graph showing an interpolated relationship between magnetic flux density and magnetic field strength for a processed steel core;

DETAILED DESCRIPTION OF PREFERRED EMBODIMENTS OF THE INVENTION

Figure 1:
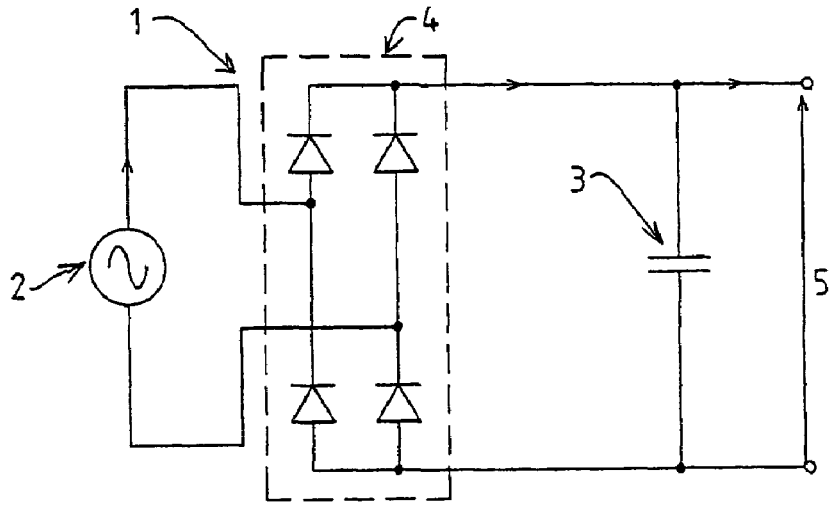
FIG. 1 is a schematic view of the rectifier circuitry of a basic SMPS.

Turning first to FIG. 1, the circuitry of a rectifier stage of a basic SMPS 1, which is connected to an input AC power source 2, comprises bulk capacitor 3 which is connected to the power source 2 by a forward-biased diode bridge 4. The diode bridge 4 operates in such a way that current may only flow from the power source 2 to the bulk capacitor 3, and not in the opposite direction. The bulk capacitor 3 is connected in parallel with a load 5, representing the power delivered by the SMPS to the machine (e.g. a personal computer) of which the SMPS forms a part.

Figure 2:
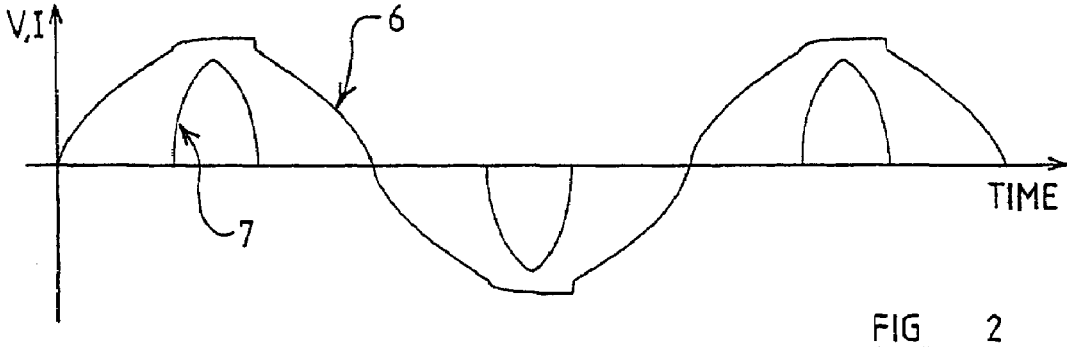
FIG. 2 is a graph of input voltage and current waveforms of the SMPS of FIG. 1 against time.

As described above, current only flows from the power source 2 to the bulk capacitor 3 and the load 5 during a fraction of the duty cycle of the AC power source 2. FIG. 2 shows a graph of how the input voltage wave form 6 and the input current wave form 7 vary with time, in which this effect can be clearly seen.

Figure 3:
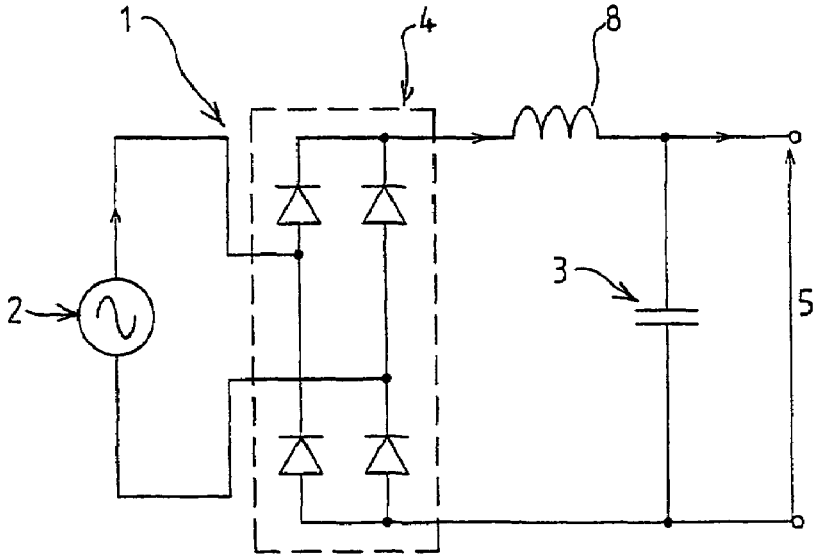
FIG. 3 is a schematic view of the rectifier circuitry of a SMPS incorporating a passive power factor correction inductor.

FIG. 3 shows the SMPS 1, incorporating a passive power factor correction inductor 8, located between the diode bridge 4 and the bulk capacitor 3. The presence of such an inductor 8 leads to the drawing of a smoother current from the power source 2, and hence to a reduction in the level of harmonics introduced into the power source 2.

Figure 4:
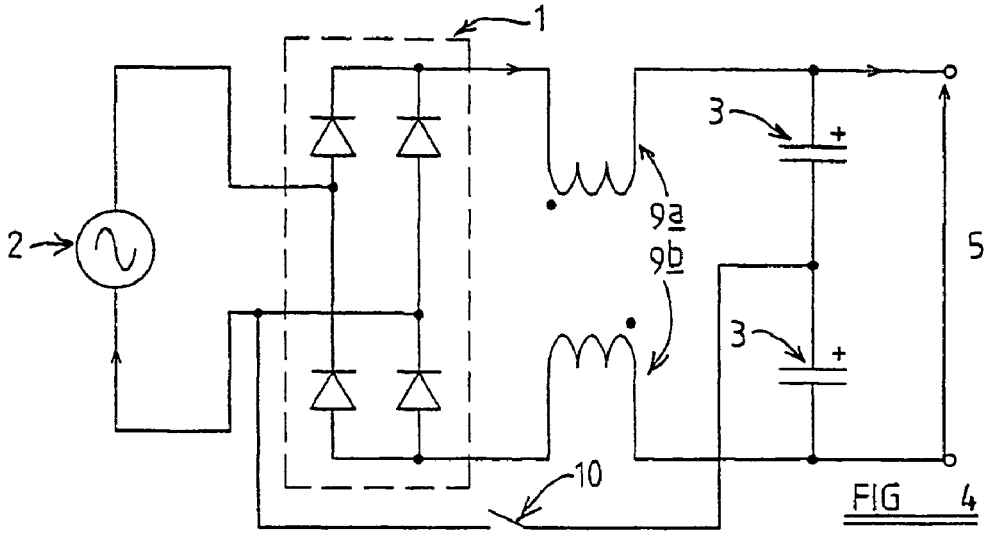
FIG. 4 is a schematic view of the rectifier circuitry of a further SMPS incorporating a pair of passive power factor correction inductors.

FIG. 4 shows a variation on the circuit of FIG. 3, which may be used in both a standard rectifier mode (for instance 230 volts, as used in Europe) and in a voltage doubler mode (for instance 100 volts, as used in Japan). The circuit comprises two capacitors 3 in series with one another instead of a single bulk capacitor and comprises an inductor 9 which has two windings 9*a*, 9*b* wound around the same core. A (usually mechanical) select switch 10 is connected from a point between the two capacitors 3 to a location between the power source 2 and the diode bridge 4. The select switch 10 may be used to switch between the standard rectifier mode and the voltage doubler mode. The pair of windings 9*a*, 9*b* are connected in series in standard rectifier operation and in quasi-parallel (one of the pair of windings 9*a*, 9*b* conducting for one half of each full duty cycle) in voltage doubler operation. The location of the inductor 9 between the diode bridge 4 and the bulk capacitors 3 allows the inductor 9 to limit the current harmonics introduced into the power source in both modes of operation. The flexibility of operation of such a SMPS is commercially useful.

Figure 5:
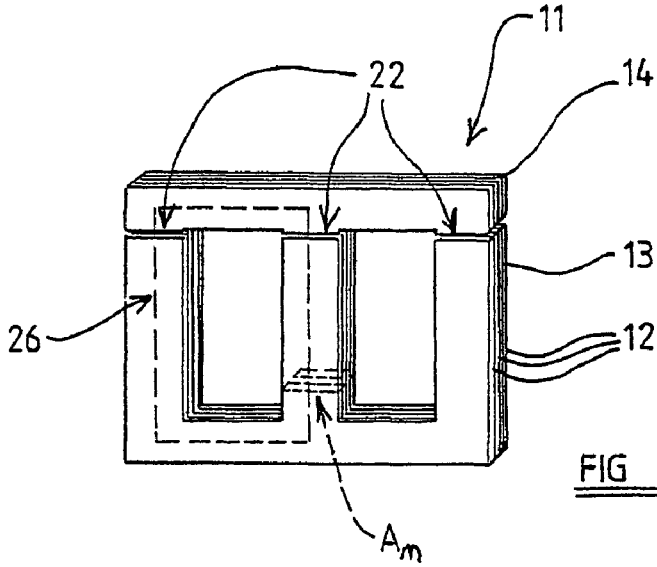
FIG. 5 is a view of a core for use in constructing a passive power factor correction inductor.

FIG. 5 shows a laminated iron core 11 for use in constructing an inductor embodying the present invention. The core 11 comprises several laminations 12, which are substantially the same shape as one another. Each lamination 12 comprises two portions, the first 13 of which is "E"-shaped, and the second 14 of which is "I"-shaped. The first and second portions 13, 14 are placed adjacent one another such that the "I"-shaped portion 14 is placed across the free ends of the three limbs 15 of the "E"-shaped portion 14. When the two portions 13, 14 are so positioned, the lamination 12 takes the form of a rectangle, bisected along its length by the central limb 15 of the "E"-shaped portion 14. The core 11 is constructed by stacking the laminations 12 on top of one another in an aligned fashion, and this design of core is known as an "E-I" pattern core.

Figure 6:
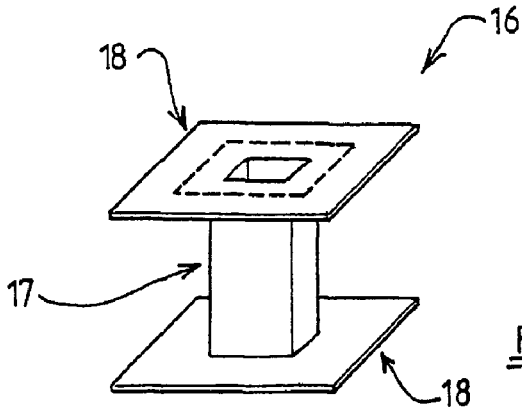
FIG. 6 is a view of a coil former for use in constructing a passive power factor correction inductor.

FIG. 6 shows a coil former 16 to be used to construct an inductor embodying the present invention. The coil former 16 comprises a central column 17 of rectangular cross section, each of the ends of the central column 17 being open and terminating in an outwardly-projecting rectangular flange 18. The internal dimensions of the central column 17 are such that it may be placed in a slide fit over the central limb 15 of the "E"-shaped portion 13 of the core 11.

Figure 7:
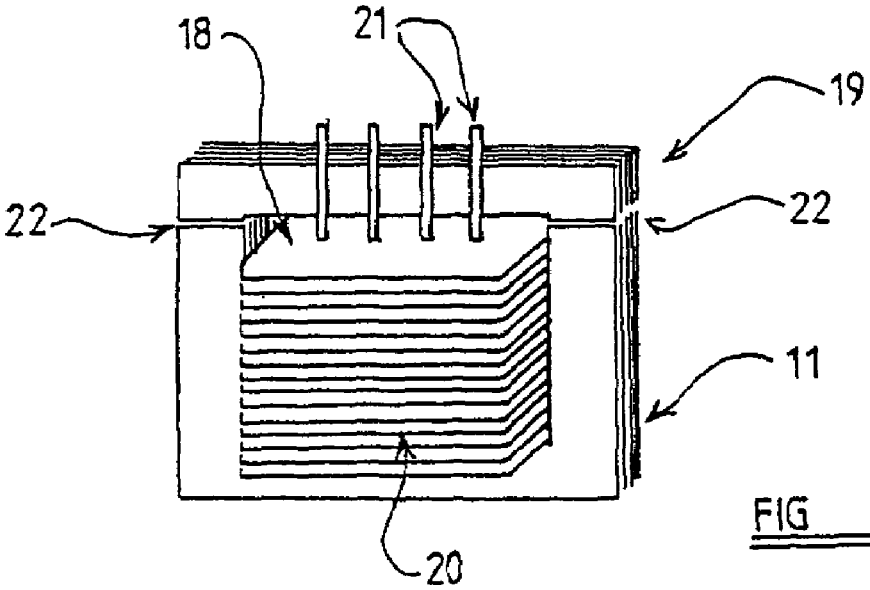
FIG. 7 is a view of a passive power factor correction inductor comprising the core of FIG. 5 and the coil former of FIG. 6.

FIG. 7 shows an inductor 19 comprising the core 11 with the coil former 16 placed over the central limb 15 of the "E"-shaped portion 13 thereof. The coil former 16 has current-carrying windings 20 wound therearound, and has fly out leads 21 extending from one flange 18 thereof for electrical connection.

Small air gaps 22 exist between the "E"- and "I"-shaped portions 13, 14 of each lamination 12 of the core 11. As described above, air gaps are commonly provided in the cores of inductors, to maximise the energy associated with the flux in the core, and to reduce the size of the inductor. In practice, as discussed above, the gaps 22 may contain thin pieces of an insulating material (not shown in the accompanying drawings.

Figure 8:
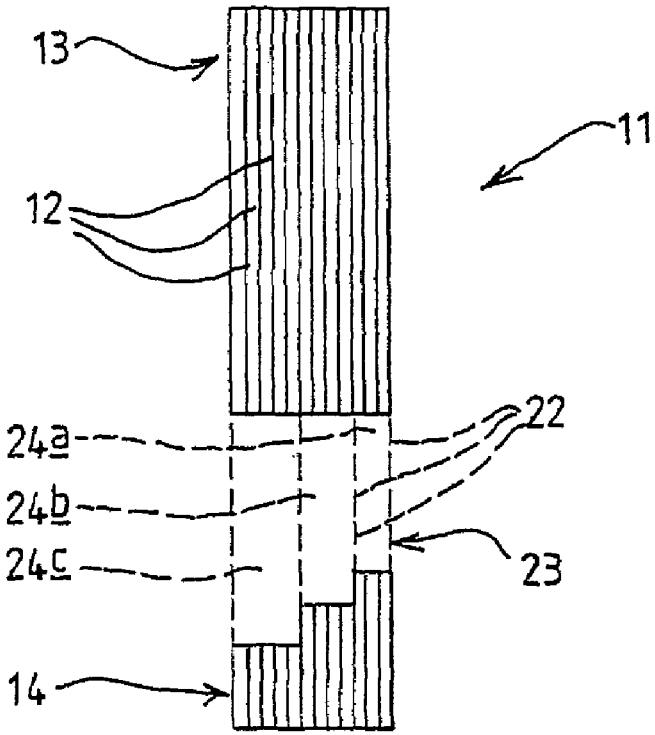
FIG. 8 is a cross-sectional view of a part of the core of FIG. 5.

FIG. 8 shows a cross-sectional view of a portion of the core 11 in the region of the air gaps 22 in the laminations 12 between the "E"-shaped sections 13 and the "I"-shaped sections 14 thereof. A combined air gap 23 comprising the air gaps 22 of each of the laminations 12 is "stepped", in that the widths of the air gaps 22 in the laminations 12 of the core 11 vary between one surface of the core 11 (parallel with one of the laminations 12 of the core 11) and the opposing side of the core 11. In this embodiment of the present invention, the combined air gap 23 comprises three such steps 24*a*, 24*b*, 24*c*.

As described above, the provision of a stepped air gap in the core of an inductor allows control to be exercised over the way in which the inductance of the inductor varies with the current flowing through the inductor. When designing an inductor having a stepped air gap it is important to know, with some degree of precision, how these two quantities will vary with one another for an inductor having air gaps of a given profile.

In order to determine this relationship, the magnetic properties of the material from which the core 11 is constructed need to be known. For a magnetic circuit through air, the graph of B (magnetic flux density) against H (magnetic field strength) is simply a straight line through the origin, i.e. the two quantities are directly proportional to one another. B and H are, in this instance, related by the equation $$B=\mu_0 H \tag{1}$$

The permeability $\mu_0$ of air (absolute permeability) is very low.

However, for typical core materials, the relationship between B and H is more complex. The two are still related by the permeability of the core material but this perameter varies with the magnetic flux density B that exists in the core material. Typical core materials exhibit a "levelling off" of magnetic flux density B at high magnetic field strength H values, a phenomenon known as saturation. The B-H relationship of a typical core material is shown in FIG. 9, which shows a curve depicting the B-H relationship of the core material during an initial magnetisation (indicated by reference number 25) and during subsequent magnetisation and demagnetisation events. An example of a suitable material from which the core 11 might be constructed is a silicon steel material. This material is relatively cheap and has the ability to store a large amount of energy in a small volume. The core 11 is formed from laminations because this mode of construction reduces power losses due to eddy currents in the core, as the resistance of the eddy current paths is increased.

In order to consider the behaviour of the inductor core 11, which has a three-step combined air gap 23, three parallel branches of the magnetic circuit formed by the core 11 arising from the provision of the three steps 24*a*, 24*b*, 24*c* of the combined air gap 23 having different widths are considered. A typical magnetic path through the core 11 is indicated by reference number 26 in FIG. 5. The relationship between the current I flowing through the current-carrying windings 20 and the magnetic flux density B for a given branch of the magnetic path is given by $$NI = \frac{BD}{\mu} \tag{2}$$

where N is the number of windings in the inductor, D is the magnetic path length of the branch and μ is the effective permeability of a composite path of the core (comprising the three parallel branches 24*a*, 24*b*, 24*c* of the core) at the particular value of magnetic flux density B. The inductance of a branch of the magnetic circuit is given by $$L = \frac{N^2}{R} \tag{3}$$

where L is the inductance measured in henrys and R is the reluctance of the circuit. Substituting an expression for reluctance into equation 3 gives:

$$L = \frac{N^2 \mu A_m}{D} \tag{4}$$

where $A_m$ (indicated on FIG. 5) is the cross-sectional area of the magnetic path perpendicular to the direction of flux (i.e. the width of the magnetic path through each lamination 12 of the core 11 multiplied by the "stack height" of the core 11).

The magnetic flux in each branch of the magnetic circuit can be defined as $$\Phi = BA_m\alpha_i \tag{5}$$

where $\alpha_i$ is the proportion of the cross-sectional area $A_m$ of the magnetic path occupied by the ith gap. For a stepped combined air gap 23 it is necessary to derive an expression for the magnetic circuit in each branch of the core 11 of the inductor 19. In order to achieve this, it is important to have an accurate model of the B-H curve of the core material employed. It would be an extremely lengthy and laborious process to describe the whole B-H curve in terms of a simple function, as complex curve matching routines would be involved to achieve the required representation. Instead, in this embodiment of the present invention, the B-H curve is broken into five segments.

In order to achieve this, the permeabilities of the core material at five values of magnetic flux density B (which are known from the manufacturer's specifications) are used to determine five points on the B-H curve for the core material. An approximate B-H curve is then constructed by interpolating between these five values, and the non-linear B-H relationship of the core material is effectively sub-divided into linear sections, the relative permeability of the core material in each section being approximated by the gradient of the interpolated relationship between the two known values of B either side of an actual value of B. The highest value of magnetic flux density B that is plotted on the graph is chosen such that the core 11 may be considered to be in a state of saturation at higher values of magnetic field strength H.

FIG. 10 shows a representation of an interpolated B-H curve for fully processed transformer steel, constructed as described above. The first segment of the B-H curve is considered to be that between zero magnetic field strength B and the first plotted value of magnetic field strength B. The second segment is considered to be the region between the first and second plotted values, and so on. The first to fifth plotted values of magnetic field strength H and magnetic flux density B will be referred to as $H_A$, $H_B$, . . . etc. and $B_A$, $B_B$, . . . etc. respectively hereafter, and are indicated as such on FIG. 10.

Considering the first segment of this approximated B-H curve, we may rearrange equation 2 to arrive at $$B_A = \frac{\mu_A N I_A}{D} \tag{6}$$

where $I_A$ is the current flowing through the inductor 19 when the magnetic flux density in the core 11 has the first plotted value $B_A$, $\mu_A$ being the effective permeability of the magnetic path at this value of magnetic flux density $B_A$.

From this it can be seen that the maximum value of the magnetic flux density $B_A$ in the first segment will depend upon the permeability $\mu_A$ of the path through which the flux is flowing (i.e. one of the three branches of the core), the number of turns in the coil N, the current flowing through the coil $I_A$ and the magnetic path length D. It should be noted that the magnetic path length D of, for example, the branch of the core 11 comprising the first step 24*a* of the combined air gap 23 is made up of the magnetic path length $D_G$ of the first step 24*a* of the combined air gap 23, the magnetic path length $D_m$ in the core material and the magnetic path length $D_B$ of any "butt" gap that may exist due to small inherent air gaps at any butt joint in the core. The expression for the magnetic path length of the ith branch of the core 11 of the inductor 19 when current $I_A$ flows through the inductor 19 is, therefore:

$$D = D_G + D_{G\beta} + D_M \tag{7}$$

As the relative permeability of the air gap and any butt gap is equal to unity, equation 6 can be written as:

$$B_A = \frac{\mu_0 NI}{D_G + D_B + \frac{D_M}{\mu_A}} \tag{8}$$

Consistent with the approach of splitting the B-H curve into five segments, an expression for any segment is required. For instance, a relationship for the third segment of the curve shown in FIG. 9 is expressible incrementally as:

$$B_C - B_B = \frac{\mu_0 N(I_C - I_B)}{D_G + D_B + \frac{D_M}{\mu_{CB}}} \tag{9}$$

Where $I_B$ and $I_c$ are the currents that must flow through the coil at the second and third plotted values of magnetic flux density $B_B$, $B_c$; and $\mu_{CB}$ is the assigned relative permeability of the core material in the third segment of the curve (i.e. the gradient of the interpolated B-H curve in the third segment).

Where there are, as in the present example, three steps 24*a*, 24*b*, 24*c* in the combined air gap 23, with different flux densities in the different gap regions, equations are required for all three branches. For a "trigap" inductor with a B-H curve split into five segments, fifteen simultaneous equations are obtained. There are a total of fifteen current values in the equations, however it is likely that three of the currents will already be known, these being the currents associated with the different power rating at which the power supply must operate. Clearly, for fifteen simultaneous equations, fifteen unknown values can be calculated. These unknowns preferably include the magnetic path lengths of the three branches of the magnetic circuit of the inductor 19.

It is important to note that the magnetic circuits associated with the three parallel branches of the core 11 will have certain properties in common, while others will be different. All three branches of the magnetic circuit will have the same core and air gap materials which share B-H characteristics. The flux for all three branches will be driven by the same winding 20, so N (the number of windings) is constant. The butt length can be assumed constant (and is often set to zero), as can the core magnetic path length for all branches.

The key differences between the three magnetic circuits are therefore the magnetic path lengths associated with the three regions of the combined air gap 23, and the widths of the three steps 24*a*, 24*b*, 24*c* as a proportion of the total area of the combined air gap 23. Because the materials are the same, some other factor must be different, in this case the current in the winding 20 required to satisfy all the other conditions in any particular magnetic path. Hence, the value of the currents that define the segment boundaries of the B-H curve for each branch must be found and, as described above, these may be determined from the fifteen formulated simultaneous equations. These currents will, hereafter, be denoted by $I_{XY}$, where X represents the segment of the B-H curve (i.e. 1 to 5) to which the boundary current relates and Y represents the branch of the inductor (i.e. 1 to 3). For example, $I_{22}$ represents the boundary current of the second segment of the B-H curve in the second branch 24*b* of the core 11 of the inductor 19.

Figure 11A:
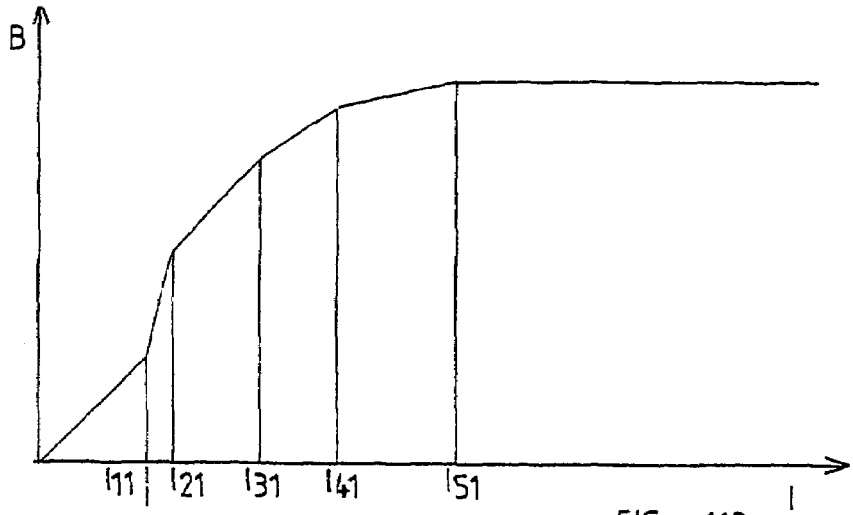
FIGS. 11*a*–11*c* are graphs which are variants on the graph of FIG. 10.
Figure 11B:
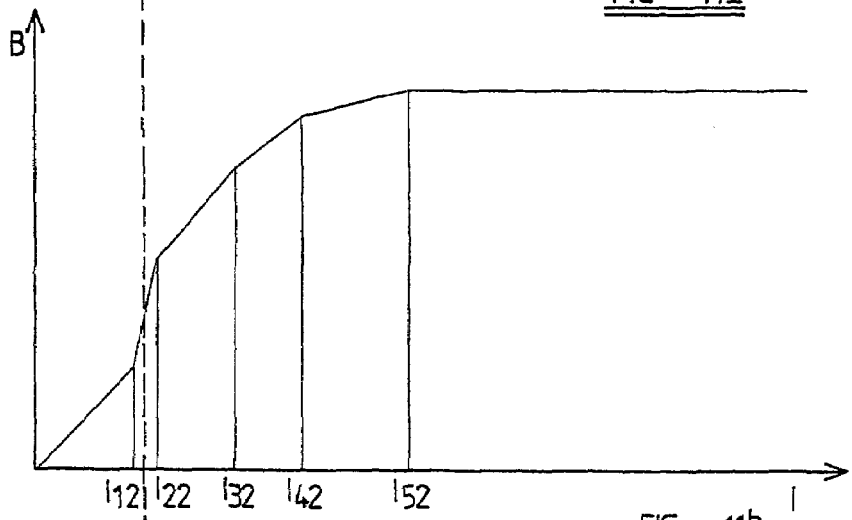
Figure 11C:
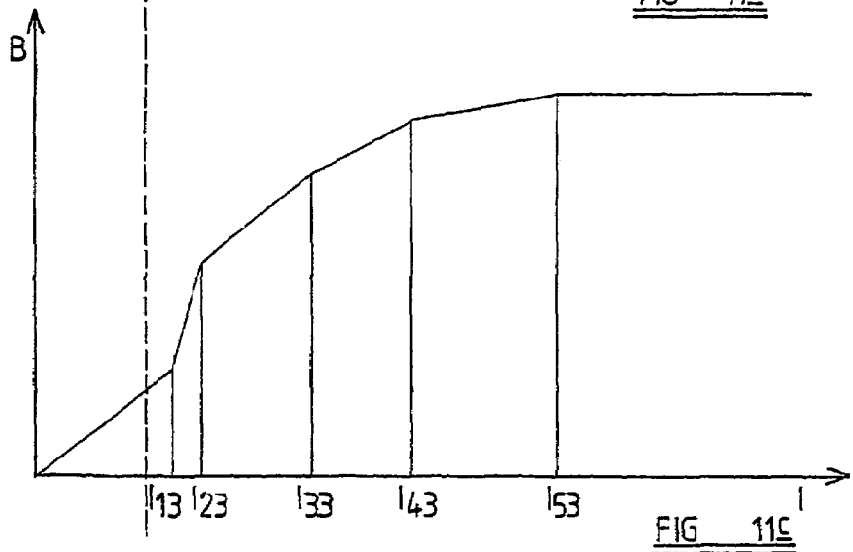

FIGS. 11*a*–11*c* show graphs representing the assignment of approximated core permeabilities for the three branches of the core 11 when boundary current $I_{11}$ flows through the inductor 19. It can be seen from these figures that $I_{12}<I_{11}<I_{13}$. When current $I_{11}$ is flowing through the core 11, the branch of the magnetic circuit comprising the first step 24*a* of the combined air gap 23 is (just) in the first segment. The branch of magnetic circuit comprising the second step 24*b* is in the second segment, and the branch comprising the third step 24*c* is in the first segment. Hence, the appropriate values of μ can be used to calculate the inductance of each branch of the magnetic circuit: $\mu_A$ is assigned to the branches comprising the first and third steps 24*a*, 24*c*, and $\mu_{BA}$ (i.e. the approximated value of the permeability of the core material in the second segment of the B-H curve) is assigned to the branch comprising the second step 24*b*.

For a trigap inductor, there will be a further fourteen defined currents in total and so this process must be repeated a further fourteen times in order to assign the appropriate relative permeabilities to each of the branches of the core 11 for all defined currents.

A further simultaneous equation may also be introduced, based on the fact that the sum of the areas of the three steps 24*a*, 24*b*, 24*c* of the combined air gap 23 must equal 100% of the cross-sectional area of the magnetic path $A_m$:

$$\alpha_1+\alpha_2+\alpha_3=1 \tag{10}$$

Once each of these calculations has been performed, it is possible to perform a final calculation of the inductance of the inductor 19 at each of the segment-defining currents. For example, for current $I_{11}$, the inductance $L_{11}$ is given by:

$$L_{11} = \mu_0 N^2 A_m \left( \frac{\alpha_1}{D_G + D_B + \frac{D_M}{\mu_A}} + \frac{\alpha_2}{D_G + D_B + \frac{D_M}{\mu_{BA}}} + \frac{\alpha_3}{D_G + D_B + \frac{D_M}{\mu_A}} \right) \tag{11}$$

If the inductance of the inductor 19 at all fifteen of the defined boundary currents is calculated using this method, the results may be plotted and interpolated between to arrive at a relationship between the inductance L of the inductor 19 and the current I flowing therethrough.

Figure 12:
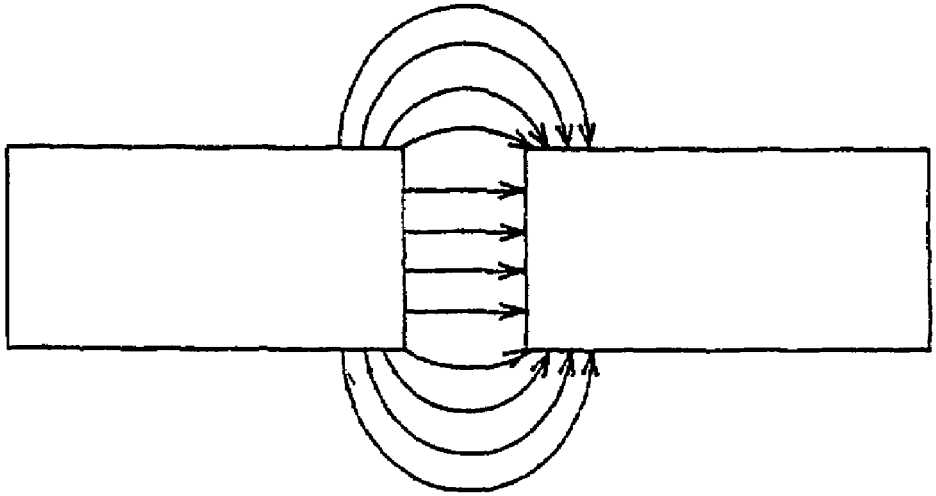
FIG. 12 is a schematic view of lines of magnetic flux around an air gap in a magnetic circuit.

One correction that needs to be made to the calculated inductance/current relationship of the inductor 19 arises from an effect known as "fringing". At the point in a magnetic circuit where the magnetic flux flows through an air gap, it will flow not only in a straight path across the gap but also through less direct paths through the adjacent air space. FIG. 12 shows a schematic representation of the lines of magnetic flux around an air gap in the magnetic circuit. It is known from equation (3) that the inductance of a magnetic circuit is inversely proportional to the reluctance thereof. If, therefore, the total reluctance is decreased by the presence of a fringing reluctance in parallel with the gap reluctance, then the overall inductance will increase:

$$R_{TOTAL} = R_{CORE} + \frac{R_{GAP}}{\left(\frac{R_{GAP}}{R_{FRINGING}} + 1\right)} \tag{12}$$

In practice, fringing is found to have a substantial effect on the inductance of an inductor. For the widths of air gap appropriate for passive power factor correction inductors, the actual inductance will be around 30% higher than that expected from the basic design equations considered above. Fringing can, therefore, be a beneficial effect which may be taken into consideration when pursuing an optimised design of passive power factor correction inductor.

Further corrections may be made to the result obtained using the above analysis, depending on the conditions under which the inductor is to be used, or the level of accuracy required, and these corrections will be within the knowledge of a person of ordinary skill in the art.

It will be readily appreciated by people skilled in the art that the above method provides a powerful tool for calculating the inductance/current characteristics of a passive PFC inductor comprising a core having a stepped air gap, which may be used to drastically reduce the time and effort required to produce an inductor to meet any given set of regulations governing the harmonics that may be introduced into a power supply.

In the above embodiment of the present invention, the core 11 of the inductor 19 has three steps. However, it will be immediately obvious to a person of ordinary skill that the present invention is not limited to such a core, and that the above-described method may be readily applied to an inductor whose core contains a gap having more or fewer steps. It is also envisaged that the method may be applied to an inductor whose core has an air gap with a continuously varying width.

While the above embodiment has been described in relation to a SMPS, it will be apparent to a person of ordinary skill in the art that the present invention is not limited to use with SPMS's, and may be used in any situation where electrical energy drawn from an AC power supply is converted to a smoothed DC form using a rectifier and capacitor.

In the present specification "comprises" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A method of manufacturing an inductor having a core comprising an air gap having a varying width, the method comprising:

designing the inductor, including the steps of:

defining physical parameters of the core of the inductor, the physical parameters including dimensions of the air gap;

defining a plurality of branches of the core;

approximating the relative permeability of the core material by interpolating between first and second known values of magnetic flux density that exist in the core material when the core material is exposed to first and second values of magnetic field strength, respectively;

calculating boundary currents that must flow through the inductor for each of the first and second known values of magnetic flux density to exist in each branch of the core; and establishing the inductance of the inductor at each of the calculated boundary currents, and constructing the inductor.

2. A method according to claim 1, further comprising the step of interpolating between the inductances of the inductor at each of the calculated boundary currents to approximate a continuous inductance/current relationship for the inductor.

3. A method according to claim 1, further comprising the step of calculating the magnetic path length of each branch of the core when each of the first and second known values of magnetic flux density exists in that branch of the core.

4. A method according to claim 1, wherein the step of defining the dimensions of an air gap comprises the step of defining the dimensions of a plurality of steps of the air gap, the steps having different widths.

5. A method according to claim 4, wherein the step of defining the dimensions of a plurality of steps of the air gap comprises the step of defining the dimensions of three steps of the air gap.

6. A method according to claim 4, wherein the step of defining a plurality of branches of the core comprises the step of defining a plurality of branches of the core each of which comprises a step of the air gap.

7. A method according to claim 1, wherein the step of defining dimensions of the air gap comprises the step of defining a continuously varying width of the air gap.

8. A method according to claim 7, wherein the step of calculating the magnetic path length of each branch of the core when each known value of magnetic flux density exists in that branch of the core comprises the step of solving the equation $$D=D_G+D_B+D_M$$

where D is the magnetic path length of the branch of the core in question, $D_G$ is the magnetic path length of the air gap in that branch of the core, $D_B$ is the magnetic path length of any butt gaps that exist in the core and $D_M$ is the magnetic path Length in the core material in that branch of the core.

9. A method according to claim 8, wherein the step of calculating boundary currents that must flow through the inductor for each of the known values of magnetic flux density to exist in each branch of the core comprises the step of solving the equation $$B_n = \frac{\mu_n N I_n}{D}$$

where $B_n$ is the nth known value of magnetic flux density, $\mu_n$ is the relative permeability of the core material when the nth value of magnetic flux density exists in the core material, N is the number of turns of a winding of the inductor and $I_n$ is the boundary current that must flow through the inductor for the nth value of magnetic flux density to exist in the branch of the core in question.

10. A method according to claim 9, further comprising the step of assigning values of relative permeability to each branch of the core of the inductor for each of the calculated boundary currents.

11. A method according to claim 10, wherein the step of establishing the inductance of the indicator at each, of the calculated boundary currents comprises the step of solving the equation $$L = \mu_0 N^2 A_m \sum_i^n \left( \frac{\alpha_i}{D_G + D_B + \frac{D_M}{\mu_i}} \right)$$

where L is the inductance of the inductor at a selected boundary current, $A_m$ is the cross-sectional area of the magnetic path perpendicular to the direction of flux, y is the total number of branched of the core, $\alpha_i$ is the proportion of $A_m$ occupied by the it branch of the core, $\mu_i$ is the relative permeability assigned to the ith branch of the core when the boundary current in question flows through the inductor and n is the total number of branches of the core.

* * * * *